US007261075B2

(12) United States Patent
Hofmann

(10) Patent No.: US 7,261,075 B2
(45) Date of Patent: Aug. 28, 2007

(54) HYDRAULIC SUPPORT ELEMENT

(75) Inventor: Georg Hofmann, Hassfurt (DE)

(73) Assignee: Ina Schaeffler-KG, Herzogenaurach (DE)

( * ) Notice: Subject to any disclaimer, the term of this patent is extended or adjusted under 35 U.S.C. 154(b) by 21 days.

(21) Appl. No.: 10/562,941

(22) PCT Filed: Jun. 3, 2004

(86) PCT No.: PCT/EP2004/005976

§ 371 (c)(1),
(2), (4) Date: Dec. 29, 2005

(87) PCT Pub. No.: WO2005/017323

PCT Pub. Date: Feb. 24, 2005

(65) Prior Publication Data

US 2006/0137638 A1 Jun. 29, 2006

(30) Foreign Application Priority Data

Jul. 17, 2003 (DE) ..... 103 32 362

(51) Int. Cl.
*F01L 1/14* (2006.01)

(52) U.S. Cl. ..... 123/90.48; 123/90.51; 123/90.52; 123/90.55; 123/90.45; 74/569

(58) Field of Classification Search ..... 123/90.48, 123/90.51
See application file for complete search history.

(56) References Cited

U.S. PATENT DOCUMENTS

| | | | | | |
|---|---|---|---|---|---|
| 4,228,771 | A | * | 10/1980 | Krieg | 123/90.55 |
| 4,430,970 | A | * | 2/1984 | Holtzberg et al. | 123/90.51 |
| 5,284,112 | A | * | 2/1994 | Takehara et al. | 123/90.48 |
| 5,325,825 | A | * | 7/1994 | Schmidt et al. | 123/90.39 |
| 5,361,648 | A | * | 11/1994 | Murakami et al. | 74/569 |
| 5,622,147 | A | * | 4/1997 | Edelmayer | 123/90.35 |
| 5,655,487 | A | * | 8/1997 | Maas et al. | 123/90.16 |
| 5,862,785 | A | | 1/1999 | Blowers | |
| 5,875,748 | A | | 3/1999 | Haas et al. | |
| 5,901,676 | A | | 5/1999 | Edelmayer | |

FOREIGN PATENT DOCUMENTS

| | | |
|---|---|---|
| DE | 44 42 932 A1 | 6/1996 |
| DE | 195 00 575 A1 | 7/1996 |
| DE | 195 15 434 A1 | 10/1996 |
| DE | 197 06 738 A1 | 8/1998 |
| DE | 198 30 427 A1 | 1/2000 |
| EP | 0 953 734 A1 | 11/1999 |

* cited by examiner

*Primary Examiner*—Thomas Denion
*Assistant Examiner*—Kyle M. Riddle
(74) *Attorney, Agent, or Firm*—Lucas & Mercanti, LLP

(57) ABSTRACT

The invention relates to a hydraulic support element (1) for a valve gear for an internal combustion engine. Said element consists of a cylindrical hollow case (2) in whose bore hole (3) a pressure piston (4) made of a glass or carbon fibre reinforced plastic is arranged.

15 Claims, 1 Drawing Sheet

1
2
3
4
4a
4b
5
6
7
8
9
10
11
12
13
14
15
16
17
18
19
20
21
22
23
24
25
26

HYDRAULIC SUPPORT ELEMENT

FIELD OF THE INVENTION

The invention relates to a hydraulic support element for a valve train of an internal combustion engine, having a hollow cylindrical housing, in the bore of which a pressure piston runs in an axially moveable manner, one end of said piston projecting beyond an edge of the housing and said piston having on that end face a head for mounting a rocker arm and having a non-return valve on its end facing away from the head, a high pressure space for hydraulic medium being generated between the end facing away and an opposing base of the housing, said high pressure space capable of being supplied with the hydraulic medium from a storage space situated above the end facing away and enclosed by the pressure piston.

BACKGROUND OF THE INVENTION

A generic support element is previously known from DE 197 06 738 A1. The pressure piston of this likewise comprises an upper and lower part, the lower part having a hydraulic play compensation device.

It is disadvantageous that the production of the upper part has proven to be relatively complex. This necessitates, for example, an extrusion process with subsequent heat treatment and several grinding processes. Undesired lateral forces can also occur on account of the relatively short guide length of the upper part in the housing. The annular groove and the circlip, acting as a retaining lock, likewise require further outlay in terms of construction and assembly. In addition, placing the ring, in the lower region of the upper part, on a facing end side of the lower part can bring about a so-called "wobble" which causes an equally undesired transmission of force into the support element. In order to keep this "wobble" as small as possible, the end surfaces of the upper and lower parts which face one another are therefore ground extremely accurately. It is finally noted that the abovementioned pressure piston is of relatively heavy design and thus has potential for optimization with regard to a lightweight construction.

OBJECT OF THE INVENTION

It is therefore an object of the invention to produce a support element of the abovementioned type which has none of the cited disadvantages.

ACHIEVEMENT OF THE OBJECT

This object is achieved according to the invention by virtue of the fact that the pressure piston consists, at its end which projects beyond the edge of the housing and in at least a portion which adjoins this end within the housing and extends into the vicinity of the non-return valve, of synthetic material reinforced with glass fibers or carbon fibers.

The disadvantages cited in the introduction to the description are effectively avoided as a result of this. The pressure piston can be produced, preferably by injection molding, in a very simple and cost-effective manner. The guide length of the pressure piston in the bore of the housing is simultaneously increased significantly with the result that lateral forces introduced by the abutting rocker arm can be better supported. This measure arises in particular from the smooth-surfaced design of the upper part of the pressure piston at least within the bore of the housing. If the upper part of the pressure piston, as in the subject matter of a further subclaim, is elongated as far as into a bore in its lower part by means of an extension, it thus has an even longer guide length.

In any case, a solution in which the pressure piston having an upper and lower part consists entirely of a single synthetic part is also conceivable and included within the scope of protection of the invention. The joining measures between the upper part and the lower part are thus dispensed with. The term "synthetic" refers in particular to such a material as can be processed by means of injection molding, hence for example organically originating material or so-called "plastic". Aluminum die castings or sintered metals can also be considered.

The further strengthening intermediate layers listed in the claims, with even more materials for inclusion in their place being accessible to the person skilled in the art, contribute significantly to the wear resistance and to the strength of the pressure piston.

According to a further subclaim, it is proposed to produce only the upper part of the pressure piston from the synthetic material and to manufacture the lower part with the hydraulic play compensation device from previously implemented, metallic material. This measure is particularly favorable in terms of production.

A simple retaining and transportation lock of the support element is disclosed in a further subclaim. According to this, wedge-like catch projections are molded onto an outer casing of the pressure piston, expediently on its upper part. These meet an upper stop against an annular step of an annular groove in the bore of the housing. If appropriate, the catch projections can also be separate components. It is also conceivable to dispense with the catch projections and hence the abovementioned locking completely.

In a refinement of the invention, it is also proposed, with regard to the two-part design of the pressure piston, to distribute elastically or plastically deformable studs around the circumference of a ring, by means of which ring the upper part rests on the lower part. These studs expediently have a relatively small contact area, with the result that a linear or spherical contact is made. The person skilled in the art will design the studs in such a way that the abovementioned wobble no longer has any or any significant effect.

Provision may also be made for generating an internal transfer of hydraulic medium from the high pressure space back to the storage space enclosed by the pressure piston via the apertures situated between the studs in the circumferential direction. If appropriate, such apertures can also be produced according to a further subclaim by radial recesses, for example of crown-like geometry, in the corresponding end side in the contact region between the upper and lower parts.

If the upper part is extended by means of an extension within a bore of the inner part, as is also implemented according to the invention, the transfer of hydraulic medium into the storage space can also take place through longitudinal slots arranged in the extension. The thermal expansions in the element are additionally extremely well compensated for on account of the longitudinal slots. In this case, a secure connection to the lower part by means of the extension should result. An additional abutment is realized by means of so-called connection studs on the lower edge region.

On account of the thus secure connection between the upper and lower parts, the entire pressure piston can perform a desired rotational movement about its longitudinal axis under the action of a compression spring in the high pressure space. An additionally improved transmission of the lateral forces is produced at the same time on account of the downward axial extension of the pressure piston.

The measures of the invention may be of equal use in the cases of so-called switchable and non-switchable support elements. The term switchable support elements refers in particular to such support elements as those in which the pressure piston may optionally be connected to the housing by coupling means.

BRIEF DESCRIPTION OF THE DRAWING

The invention is expediently described in more detail with reference to the drawing, in which.

DETAILED DESCRIPTION OF THE DRAWING

Figures 1, 2, 3:
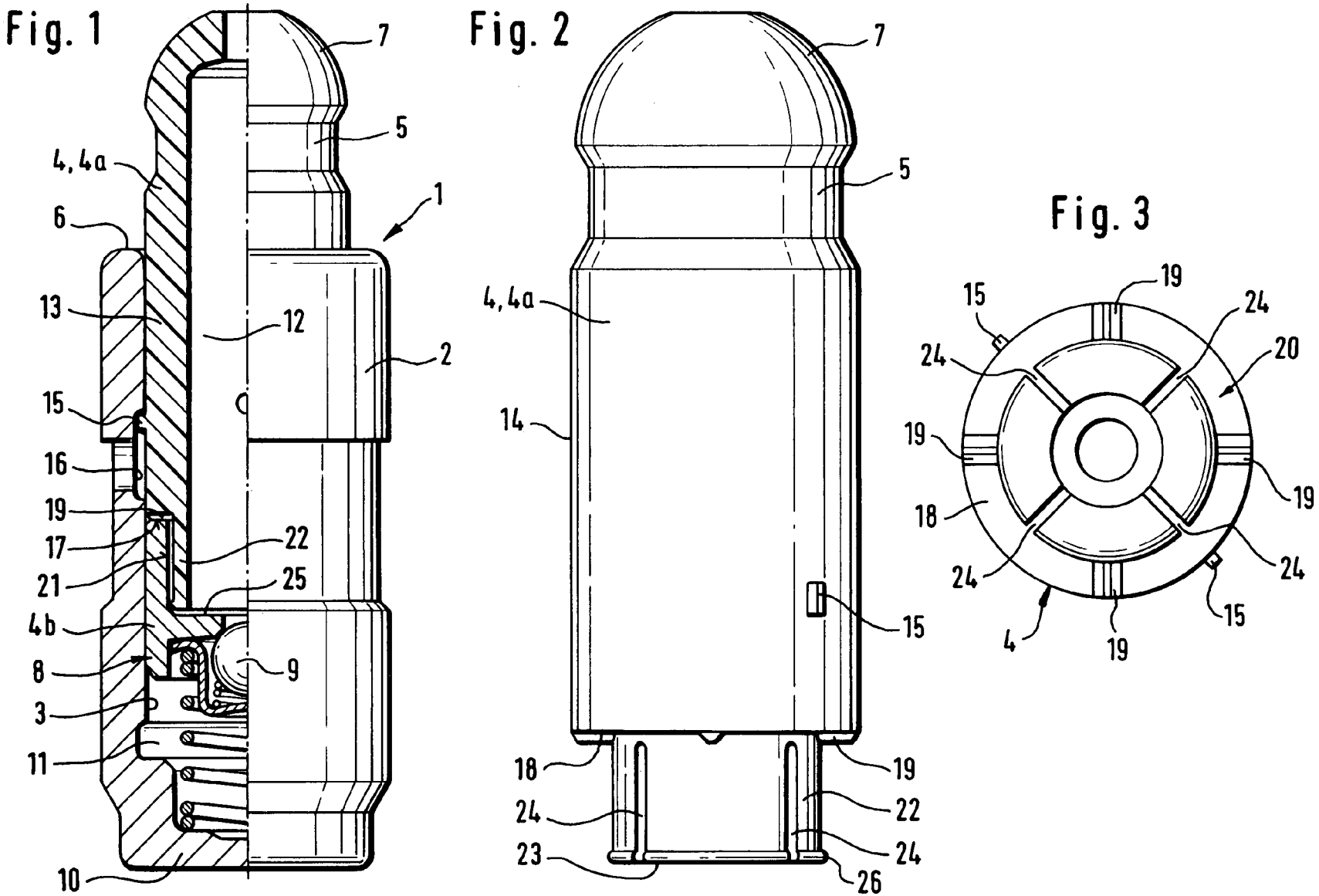
FIG. 1 shows a partial longitudinal section through a support element according to the invention.
FIG. 2 shows a view of a pressure piston of the above-mentioned support element and FIG. 3 shows a view of the pressure piston in FIG. 2 from below.

FIG. 1 illustrates a hydraulic support element 1 which has a hollow cylindrical housing 2. A pressure piston 4 runs in an axially moveable manner in a bore 3 of the housing 2. One end 5 of this pressure piston 4 projects beyond an edge 6 of the housing 2. The pressure piston 4 has a head 7 on an end side, on which head 7 a rocker arm can be mounted. As can also be seen, an upper part 4*a* of the pressure piston 4 consists of synthetic material. This synthetic material is expediently reinforced with glass fibers or carbon fibers and additionally has glass beads or carbon beads for further wear resistance or for optimizing stiffness.

An outer casing 14 of the upper part 4*a* is of entirely smooth-surfaced design within the bore 3 of the housing 2. As a result, the pressure piston 4 has, overall, an extremely good guide length in the housing 2 with the result that the tilting moment transmitted into the support element 1 by the rocker arm can be well supported.

The bore 3 of the housing 2 has an annular groove 16. The upper part 4*a* abuts against an upper side of this annular groove 16 by means of catch projections 15 which are distributed around the circumference and are preferably in one piece with and project from said upper part. A simple transportation and retaining lock for the support element 1 is thus produced by means of these catch projections 15.

According to FIG. 1, the upper part 4*a* adjoins a facing end side 17 of a lower part 4*b* of the pressure piston 4 by means of a ring 18 formed by a reduced-diameter region of the outer casing 14 of said upper part. As can be seen in FIGS. 2 and 3, the ring 18 has in this case studs 19 which are distributed about the circumference and are preferably plastically deformable. An extremely good contact area is produced in the contact region between the upper part 4*a* and the lower part 4*b* on account of these studs 19, with the result that the "wobble errors" which occur in the prior art can be successfully eliminated.

As can also be seen in FIG. 1, the reduced-diameter region of the upper part 4*a* is extended within a bore 21 of the lower part 4*b* by an extension 22. The upper part 4*a* runs in a rotationally fixed manner in the bore 21 of the lower part 4*b* by means of the extension 22. An additional connection of the upper part 4*a* to the lower part 4*b* results from connection studs 26 which can be seen in FIG. 2.

Longitudinal slots 24 in the extension 22 firstly allow for the thermal expansion to be extremely well compensated for. These secondly enable a transfer of hydraulic medium to a hydraulic medium storage space 12 which is enclosed by the upper part 4*a*. This transfer of hydraulic medium is fed from a high pressure space 11. This high pressure space 11 is situated axially between a base 25 of the lower part 4*b* and a facing base 10 of the housing 2. During a high pressure phase of the play compensation element, the hydraulic medium is pushed axially upwards between the outer casing 14 of the pressure piston 4 and the bore 3 of the housing 2 and enters the longitudinal slots 24 by means of apertures 20 between the studs 19.

Crown-like recesses or similar can also be applied to the ring 18 of the upper part 4*a* instead of the studs 19 for transfer of hydraulic medium. If appropriate, it is also conceivable to arrange the studs 19 or the like on the end side 17 of the lower part 4*b*.

The pressure piston 4 can also be manufactured entirely as a single synthetic part. The pressure piston 4 or its upper part 4*a* is advantageously produced by injection molding. This is relatively cost-effective and eliminates the need for complex precision machining measures as required in the prior art cited in the introduction to the description. It is also conceivable to produce the pressure piston 4 by powder metallurgy or to undertake further wear resistance measures such as suitable coatings in the region of its head 7. Aluminum die castings or sintered metals can also be considered as examples for the material of the pressure piston.

In a variant not directly disclosed in the drawing, the upper part 4*a* is not elongated into the bore 21 of the lower part 4*b* by means of the extension 22 but stands up "only" by means of its ring 18 on the end side 17 of the lower part 4*b*, a direct transfer of the hydraulic medium into the storage space 12 being generated by means of the apertures 20 between the studs 19.

LIST OF REFERENCE NUMBERS

1 Support element
2 Housing
3 Bore
4 Pressure piston
4*a* Upper part
4*b* Lower part
5 End
6 Edge
7 Head
8 End
9 Non-return valve
10 Base
11 High pressure space
12 Storage space
13 Portion
14 Outer casing
15 Catch projection
16 Annular groove
17 End side
18 Ring
19 Studs
20 Aperture
21 Bore
22 Extension
23 End side
24 Longitudinal slot
25 Base
26 Connection studs

The invention claimed is:

1. A hydraulic support element for a valve train of an internal combustion engine, comprising a hollow cylindrical housing having a bore in which a pressure piston runs in an axially moveable manner, one end of said piston projecting beyond an edge of the housing and said piston having on said one one end a head for mounting a rocker arm and having a non-return valve on the other end of the piston, a high pressure space for hydraulic medium positioned between the other end of the piston and an opposing base of the housing, said high pressure space capable of being supplied with the hydraulic medium from a storage space situated above the other end of the piston and enclosed by the pressure piston, wherein the one end of the pressure piston which projects beyond the edge of the housing and in at least a portion of the piston which adjoins the one end of the piston is situated within the housing and extends into the vicinity of the non-return valve, comprises synthetic material reinforced with glass fibers or carbon fibers, and wherein a catch projection is arranged on an outer casing of the portion of the pressure piston which is situated within the housing, and the bore has an annular groove in which the catch projection axially moves; and said annular groove is an upper step for the catch projection.

2. The support element as claimed in claim 1, wherein glass beads or carbon beads are embedded in the synthetic material of the pressure piston as reinforcement.

3. The support element as claimed in claim 1, wherein the pressure piston is manufactured in two parts, an upper part made from the synthetic material, said upper part being composed of the one end and the portion which ends in the vicinity of the non-return valve, and a lower part, made from metallic material, and abutting the non-return valve.

4. The support element as claimed in claim 1, wherein the catch projections in one piece with said outer casing.

5. The support element as claimed in claim 1, wherein the outer casing of the portion of the pressure piston apart from the catch projections, is of entirely or at least of largely smooth-surfaced design.

6. The support element as claimed in claim 3, wherein the upper part of the pressure piston rests on a facing end side of the lower part by means of a ring, and studs are distributed about and project from the circumference of the ring, are elastically deformable and rest on the end side.

7. The support element as claimed in claim 3, wherein the upper part of the pressure piston rests on a facing end side of the lower part by means of a ring, and crown-like radial recesses, which adjoin the respectively opposite components end side or ring, running in the ring or in the end side.

8. The support element as claimed in claim 7, wherein an aperture to let hydraulic medium into the storage space is formed between the radial recesses.

9. The support element as claimed in claim 6, wherein an aperture to let hydraulic medium into the storage space is formed between the studs.

10. The support element as claimed in claim 3, wherein the upper part of the pressure piston rests on a facing end side of the lower part by means of a ring formed by a reduced-diameter region of the outer casing of said upper part, and studs, which are distributed about and project from the circumference of the ring and are elastically deformable, and the reduced-diameter region being fixedly installed in a bore of the lower part as an extension.

11. The support element as claimed in claim 10, wherein one or more longitudinal slots project from a lower end side of the extension of the lower part to conduct the hydraulic medium by means of the longitudinal slots into the storage space through an aperture situated between the upper and lower parts of the pressure piston and formed by studs or crown-like recesses.

12. The support element as claimed in claim 10, wherein an edge region between the outer casing and a lower end side of the extension is provided with connection studs for abutment in the bore.

13. The support element as claimed in claim 1, wherein the pressure piston is produced by injection molding.

14. The support element as claimed in claim 1, wherein the support element is of non-switchable design.

15. The support element as claimed in claim 1, wherein the support element is of switchable design in order to achieve different valve strokes.

* * * * *